US012686514B2

(12) United States Patent
Spaans

(10) Patent No.: US 12,686,514 B2
(45) Date of Patent: Jul. 21, 2026

(54) ASSEMBLY, STRAP GUIDING DEVICE AND METHOD FOR PROVIDING A BULKY ITEM WITH A STRAP

(71) Applicant: Tebulo Industrial Automation B.V., Warmenhuizen (NL)

(72) Inventor: Johan Spaans, Warmenhuizen (NL)

(73) Assignee: Tebulo Industrial Automation B.V., Warmenhuizen (NL)

( * ) Notice: Subject to any disclaimer, the term of this patent is extended or adjusted under 35 U.S.C. 154(b) by 304 days.

(21) Appl. No.: 18/692,858

(22) PCT Filed: Sep. 23, 2022

(86) PCT No.: PCT/EP2022/076587
§ 371 (c)(1),
(2) Date: Mar. 18, 2024

(87) PCT Pub. No.: WO2023/046928
PCT Pub. Date: Mar. 30, 2023

(65) Prior Publication Data

US 2024/0391623 A1 Nov. 28, 2024

(30) Foreign Application Priority Data

Sep. 24, 2021 (NL) ..... 2029238

(51) Int. Cl.
*B65B 13/06* (2006.01)
*B65B 13/18* (2006.01)
(Continued)

(52) U.S. Cl.
CPC ..... *B65B 13/06* (2013.01); *B65B 13/184* (2013.01); *B65B 13/22* (2013.01); *B65B 27/06* (2013.01)

(58) Field of Classification Search
CPC ..... B65B 13/04; B65B 13/06; B65B 13/08; B65B 13/10; B65B 13/12; B65B 13/18;
(Continued)

(56) References Cited

U.S. PATENT DOCUMENTS 6,786,026 B2 9/2004 Helmrich
8,042,460 B2 10/2011 Song
8,820,227 B2 9/2014 Reimann et al.

FOREIGN PATENT DOCUMENTS

CN 112829992 A * 5/2021 ..... B65B 13/18
CN 113682517 A * 11/2021 ..... B65B 13/12
(Continued)

OTHER PUBLICATIONS

Machine English translation of CN 112829992 A, 6 pages (Year: 2026).*

(Continued)

*Primary Examiner* — Jimmy T Nguyen
(74) *Attorney, Agent, or Firm* — Ipsilon USA—NLO

(57) ABSTRACT

An assembly for applying a strap around the outer circumferential surface of a bulky item. The assembly includes a binding zone configured to receive the bulky item; a channel defined along a guiding surface of a strap guiding device that surrounds the binding zone and is configured to guide strap material around the bulky item; and a binding apparatus with a binding head for delivering the strap material to the channel and for fastening a first end of the strap material to a second end of the strap material to form the strap. The channel has two channel ends that define an opening through which the binding head can pass. The opening in the channel can be rotated to allow placement of the bulky item into the binding zone.

20 Claims, 7 Drawing Sheets

(51) Int. Cl.
*B65B 13/22* (2006.01)
*B65B 27/06* (2006.01)

(58) Field of Classification Search
CPC ..... B65B 13/184; B65B 13/22; B65B 27/06; B65B 27/10
See application file for complete search history.

(56) References Cited

FOREIGN PATENT DOCUMENTS

| | | | | | |
|---|---|---|---|---|---|
| EP | 2116470 | B1 | | 3/2011 | |
| EP | 2428452 | B1 | | 2/2013 | |
| EP | 2794401 | B1 | | 10/2014 | |
| JP | 5316202 | B2 | | 10/2013 | |
| KR | 101713206 | B1 | * | 3/2017 | ..... B65B 27/06 |
| KR | 20210003445 | A | * | 1/2021 | ..... B65B 65/02 |
| WO | 2020/114652 | A1 | | 6/2020 | |

OTHER PUBLICATIONS

Machine English translation of KR 101713206 B1, 6 pages (Year: 2026).*
Machine English translation of CN 113682517 A, 6 pages (Year: 2026).*

* cited by examiner

ASSEMBLY, STRAP GUIDING DEVICE AND METHOD FOR PROVIDING A BULKY ITEM WITH A STRAP

CROSS-REFERENCE TO RELATED APPLICATIONS

The present application is a 371 of international application PCT/EP2022/076587, filed Sep. 23, 2022, which claims priority of NETHERLANDS 2029239, filed Sep. 24, 2021, the priority of these applications is hereby claimed and these applications are incorporated herein by reference

TECHNICAL FIELD

The invention relates to an assembly and method for providing a bulky item, in particular a roll of metal sheet, with a strap around its outer circumferential surface. The invention further relates to a strap guiding device for guiding a strap around the bulky item before fastening the strap using a binding apparatus. Furthermore, the invention relates to a binding apparatus configured to be used in combination with the strap guiding device.

BACKGROUND ART

Rolls of wound sheet or strip and other bulky items can be tightened with straps to prevent them from unwinding or opening during transport. Such straps can be provided manually, but typically they are applied automatically using a binding machine.

The basic principle of such binding machines is based on positioning a bulky item within a binding zone in the binding machine and shooting a strap into a channel that extends circumferentially around the bulky item. A binding head holds one strap end and grips the other strap end after it has been guided through the channel guide. The binding head can tighten the strap by engaging a surface of the bulky item and pulling one of the strap ends. After tightening, the binding head can connect or join the strap ends, for example by applying an adhesive to two overlapping ends, or by welding the ends together. The strap, which is provided from a dispenser, is then cut loose and the binding head is repositioned to apply another strap or lifted from the bulky item. The bulky item can be removed and another bulky item that is to be provided with a strap can be arranged in its place.

Patent document U.S. Pat. No. 8,820,227 B2 describes an example of a machine for securing a strap around a roll. The machine comprises a strap guiding device with a circumferential channel with an opening for arranging the strapping guide around the roll. Before the strapping operation is carried out, the opening in the channel is closed using a movable channel section, which is customarily referred to as a bayonet. A binding head of the binding machine is arranged within the circumferential channel and engages the roll or bulky item to tighten and fasten the strap after the strap has been guided through the strap guiding device.

A problem experienced with the known binding machines is that it is difficult to access the binding head in case of a breakdown of the binding machine. Specifically, for a roll with metal wound sheet, the product may still have a high temperature when the straps are provided and it can therefore be unsafe to repair the binding head or resolve any error close to the roll. In addition, due to the positioning of the binding head within a binding zone enclosed by the strap guiding device it takes a long time to access the binding head to carry out routine maintenance.

It would be desirable to provide a method and assembly for providing rolls and other bulky items with a strap, which improves on existing processes and provides easier access to the binding head in case of breakdown and/or for maintenance.

SUMMARY OF INVENTION

Therefore, according to a first aspect of the invention, there is provided an assembly for applying a strap around the outer circumferential surface of a bulky item, the assembly comprising a binding zone configured to receive the bulky item; a channel surrounding the binding zone and configured to guide strap material around the bulky item, and a binding apparatus with a binding head for delivering the strap material to the channel and for fastening a first end of the strap material to a second end of the strap material to form the strap. The channel has two channel ends that define an opening through which the binding head can pass and wherein the binding apparatus can move the binding head to at least a first position in alignment with the channel from which the binding head can shoot the strap material into the channel, a second position inside the binding zone where the binding head can fasten the strap, and a third position outside of the binding zone.

Here the term "bulky item" is used to refer to any product or collection of products with a substantial size, for example with a minimum volume of 1 $m^3$. The bulky item may be formed by steel plate wound in the form of a roll. Alternatively, the bulky item may be any other product of substantial size that needs to be provided with a strap. In embodiments, multiple straps may be provided around the bulky item.

The term "strap" is used for any binding means that has a sufficient stiffness to enable the strap to be guided through the channel after the strap has entered the channel at one of the channel ends. For example, the strap may be a flat tape made of a metal or plastic material. In specific embodiments, the strap may be made of steel or Polyethylene terephthalate (PET).

The term "binding zone" refers to the area that is at least partially circumferentially surrounded by the channel. A bulky item may be arranged in the binding zone to be provided with a strap. The binding head can be moved to a first position to shoot the strap into the channel and to a second position inside the binding zone to fasten and tighten the strap. Typically, at the second position the binding head engages the outer circumferential surface of the bulky item.

The term "shoot" is used to indicate that the binding head provides the drive to guide the strap through the channel.

Advantageously, the binding head can also be moved to a third position outside of the binding zone. This enables an operator to carry out maintenance to the binding apparatus more easily. Moreover, when the assembly breaks down, it is usually the binding head of the binding apparatus that malfunctions. Because the binding apparatus can move the binding head outside of the binding zone it is easier and faster to carry out emergency repairs. Further advantageous is that such repairs can be carried out at a safe place, away from other machine equipment and at a distance from the bulky item. The binding apparatus moves the binding head between the first, second and third position. This motion may be along a straight trajectory, but preferably the binding head may in addition or alternatively also be moved along a non-straight trajectory to provide more flexibility in arranging the binding head at a desired position inside and outside of the binding zone. Therefore in an embodiment, the binding head is configured to make a movement along a non-straight trajectory. Here a movement along a non-straight trajectory refers to any movement that is not rectilinear. For example, the trajectory may comprise one or more smooth curves or may comprise an abrupt angle. This provides optimal flexibility to arrange the binding head in a position wherein maintenance can be carried out quickly and safely.

Conventional strap guiding devices typically have a movable channel section near the lower surface of the bulky item to enable easy arrangement of the bulky item on a support. Typically, such an opening along the lower surface can be opened and closed using a bayonet. Disadvantageous to this solution is that the channel guide surface needs to be interrupted. Consequently, a large number of transitions or interruptions along the guiding surface occur, which may lead to the strap getting jammed.

Therefore according to an important aspect of the invention there is provided a strap guiding device comprising a channel support supporting a guiding surface, wherein the channel is defined along the guiding surface. The opening in the channel can be rotated to allow placement of the bulky item into the binding zone.

In an embodiment, the opening in the channel can be rotated between at least a first position wherein the bulky item can be placed within the strap guiding device and a second position wherein the opening in the channel is facing the binding apparatus. By rotating the opening between the first and second position, no interruptions along the guiding surface are required. This reduces the risk that a strap gets stuck within the channel. In an embodiment, the opening in the channel is facing downward in the first position of the opening in the channel. This enables the easy arrangement of the bulky item on a support in the binding zone.

In an embodiment, the strap guiding device further comprises a frame for rotatably supporting the channel support; and a drive system for rotating the channel support. The drive system may be used to automatically rotate the opening in the channel from the first to the second position and back.

In an embodiment, the binding apparatus may comprise an arm carrying the binding head. The arm may translate the binding head between the first, second and third positions. The movement of the binding head through the opening typically takes place along a straight line as a straight movement makes it easiest to pass the binding head through the opening. However, the trajectory along which the binding head is moved may in addition also comprise a non-straight portion to allow the binding head to be moved to any preferred first and third position.

Alternatively, in an embodiment the binding apparatus may be a robot provided with at least four degrees of freedom, or at least five degrees of freedom or at least six degrees of freedom. It will be understood that every additional degree of freedom provides more flexibility to move the binding head. Specifically, the ability of the robot to also tilt the binding head along an axis parallel or perpendicular to the opening in the channel may ease passage of the binding head through the opening. In addition, the additional degrees of freedom make the binding apparatus flexible to use with varying sizes of bulky items and/or positions of the opening in the channel as the precise trajectory of the binding head can easily be adjusted.

Further advantageous to the movability of the binding head is that multiple binding zones can be created. In an embodiment, the assembly comprises at least two separate channels configured to be used alternatingly in combination with the binding head of the binding apparatus. The two separate channels may define two separate binding zones that can be operated by a single binding apparatus with a single binding head. This is enabled by the fact that the binding head of the binding apparatus can be moved inside and outside of a binding zone. Advantageously, a strap may be provided around a bulky item in a first binding zone while at the same time a previously strapped item in a second binding zone can be replaced by a new bulky item to be strapped. This reduces the time that the binding apparatus is in an idle mode, thereby reducing process costs.

In an embodiment, the binding apparatus comprises a channel guide segment, configured to span or close the opening between the channel ends. In this context "to close the opening" refers to a precise closure of the opening, whereas "to span the opening" may also refer to an opening that is approximately closed by arranging the channel guide segment between the channel ends. The term "channel guide segment" is used to refer to an element or group of elements that can provide guidance to the strap before it has entered the first channel end and after it has left the second channel end. The channel guide segment may partially continue within the binding head, but may also comprise one or more channel guide portions that are connected to one or both sides of the binding head.

The channel is typically defined within a strap guiding device and in embodiments the channel guide segment is configured not to engage with the strap guiding device. Instead the channel guide segment is held in a position within the opening between the channel ends and thus spans the opening. One or more small gaps may be present in the approximately closed position between the channel ends and the respective ends of the channel guide segment.

In an embodiment, the channel guide segment is formed as an arc segment having an arc angle between 60 and 100 degrees; preferably between 70 and 90 degrees. Alternatively, the channel guide segment may for instance be straight. It will be understood that an arc shape is not limited to a circular arc shape, but may also approximate an arc shape using a plurality of straight edges.

In an embodiment, the channel guide segment has two segment ends and the channel guide segment is configured to provide for a gap between each of the channel ends and the segment ends when the channel guide segment spans the opening between the channel ends, wherein the gaps may have a size of maximum 15 mm, preferably the gaps have a size between 5 and 10 mm. The gaps typically extend over the full width of the channel and allow easy passage of the binding head with the channel guide segment into and out of the binding zone through the opening between the channel ends.

In an embodiment, the channel is defined along a guiding surface that continues uninterruptedly between the channel ends. Here an uninterrupted guiding surface refers to a surface without seams or other disruptions along the circumferential direction of the channel between the two channel ends. An uninterrupted surface reduces the risk that that the strap accidentally exists the channel, or gets jammed at a seam. Alternatively, the guide surface may be interrupted and/or comprise one or more seams.

In an embodiment, the channel guide segment has two segment ends and a segment guiding surface between the two segment ends, wherein the guiding surface at the channel ends is non-planar and wherein the segment guiding surface at the segment ends is complementary in shape to the guiding surface. For example, the guiding surface at the channel ends may be provided with a transverse end surface and the segment guiding surface may be provided with a complementary transverse end surface. Alternatively, the guiding surface may comprise one or more protrusions and/or recesses, and the segment guiding surface may comprise mating recesses and protrusions. Advantageous to a non-planar outer end is that straps are less prone to get jammed at the transition between the guiding surface and segment guiding surface. In embodiments, the end of the guiding surface may also be planar.

In an embodiment, the channel guide segment is straight or arc shaped. These shapes provide optimal guidance to the channel strap while the strap end is passed through the channel guide segment. Nevertheless, it will be understood that a channel guide segment having another shape that can span or close the opening between the channel ends might be provided as well.

In an embodiment, the binding head has two sides, each side facing one of the channel ends, and the channel guide segment extends from one or both sides of the binding head. Here both sides of the binding head refers to a front side of the binding head, i.e., the side from where the strap end is guided into the channel guide, and a receiving side of the binding head, i.e., the side where the strap end is received from the channel guide. Providing a channel guide segment that extends from both sides reduces the risk of misalignment of the exit of the channel with respect to a receiving zone on the receiving side of the binding head. Alternatively, the channel guide segment may only extend from one side. The binding head may then shoot the strap directly into the channel or may receive the strap directly from the channel.

In an embodiment, the assembly further comprises a support for supporting the bulky item in a way that access to at least part of a lower surface of the bulky item is provided. The support provides access to the lower surface of the bulky item and may enable the channel to extend all around the outer circumferential surface of the bulky item. It will be understood that for certain bulky items, for example for a stack of pallets, a support is not needed because the channel can already reach a lower surface even when the bulky item is provided on a flat floor. In an embodiment, the support is a saddle.

In an embodiment, the channel is arc shaped or comprises a section having an arc shape. The arc shape may define part of a substantially circular path. Here the term "substantially" is used to also include an oval or spiral path that approximates a circular path. At each position of the path, a radius of curvature can be defined and typically the radius of curvature along the substantially circular path does not deviate more than 10% from an average radius of curvature along the path. The substantially circular path enables smooth guidance of the strap through the channel and limits the risk that the strap material gets stuck in the channel guide. Alternatively, the substantially circular path may be formed by a large number of straight edges, e.g., at least five straight edges, or at least ten straight edges, forming a polygonal shape that approximate the shape of a substantially circular arc.

In a further embodiment, the arc has an arc angle between 180 and 300 degrees, preferably between 260 and 300 degrees. Consequently, the opening between the two channel ends provides sufficient access and flexibility to arrange bulky items on the support and/or to remove them. Preferably, the arc has an arc angle of at least 260 degrees guide since larger openings will be more difficult to close.

In an embodiment, the arc has a radius between 0.5 m and 2 m, preferably between 0.75 m and 1.5 m. Such a channel defines a binding zone that is sufficiently large for most bulky items. Nevertheless, it will be understood that a further advantage of the invention is that the design of all components is easily scalable. Hence the size of for instance the channel can be adjusted based on the required size for the binding zone.

In an embodiment, the channel circumferentially extends along a path having a polygonal shape, preferably wherein the opening is provided as a missing polygon side of the polygonal shape. It will be understood that the polygonal shape is configured to be rotatable without being blocked in rotational movement by other components of the assembly. The polygonal shape may be regular, for example following a hexagon shape, or the polygonal shape may be irregular. In embodiments a combination may be provided wherein the channel may comprise part of a polygonal shape and a shorter arc shaped segment that together provide the continuous channel with two channel ends that define an opening through which the binding head can pass. For example, the shorter arc shaped segment may have an arc angle between 90 and 180 degrees.

In an embodiment, the bulky item is a roll with wound metal sheets. The assembly is particularly suited for use in heavy industries, such as the steel industry. Steel plate can be wound in the form of a roll and is typically still very hot when a strap is applied around the roll. The flexibility of the binding apparatus to bring the binding head to a position for maintenance outside of the binding zone implies it is also spaced from the bulky item. Consequently, an operator can safely carry out their work without having to risk injury by touching the hot roll.

In an embodiment, the assembly is configured to apply a strap made of metal, preferably a strap made of steel. Typically, the binding head is adjusted to process metal straps. In addition, the guiding surface of a channel that is to be used to guide metal straps will be manufactured of metal as well, preferably of steel. Therefore in an embodiment, the guiding surface is made of steel.

In an embodiment, the assembly is configured to apply a strap made of a plastic material, preferably a thermoweldable plastic material. Typically, the binding head is adjusted to process plastic straps. In addition, a guiding surface that is going to be used to guide plastic straps will be manufactured of a plastic material as well. Therefore in an embodiment, the guiding surface is made of a plastic material, preferably made of Polyethylene terephthalate (PET). Providing a guiding surface with the same type of material as the strap reduces the wear of the guiding surface and prevents the straps from getting damaged.

In an embodiment, the channel is configured to guide a strap having a width between 10 and 35 mm. For example, the channel may be configured to guide a steel strap having a width of 12, 15, 19, 25 or 32 mm. Alternatively, or in addition, the channel may be configured to guide a plastic strap having a width between 15 and 19 mm.

In an embodiment, the assembly further comprises a strap dispenser. The binding apparatus receives the strap material from the strap dispenser. In embodiments, the binding apparatus further comprises a strap accumulator and strap material may be provided from the strap dispenser to the strap accumulator.

According to a second aspect of the invention, and in accordance with the effects and advantages as described above, there is provided a strap guiding device for guiding a strap around the outer circumferential surface of a bulky item, the strap guiding device comprising: a channel at least partially circumferentially extending around a binding zone for the bulky item, the channel having two channel ends that define an opening through which a binding head of a binding apparatus can pass, wherein the channel ends provide access for a binding apparatus for guiding a strap through the channel; a channel support supporting a guiding surface, wherein the channel is defined along the guiding surface; a frame for rotatably supporting the channel support; and a drive system for rotating the guiding surface around a center of a substantially circular path, wherein the opening in the channel can be rotated between at least a first position wherein the bulky item can be placed within the strap guiding device and a second position wherein the opening in the channel is facing the binding apparatus.

In an embodiment, the strap guiding device further comprises a plurality of channel guide portions, wherein the plurality of channel guide portions are supported by the channel support and wherein the plurality of channel guide portions together with the guiding surface define the circumferentially extending channel, wherein the channel guide portions at least partially enclose the channel.

In an embodiment, each channel guide portion is provided with a retention system for selectively retaining the strap within the channel guide portion. This prevents a strap in the channel from accidentally escaping.

In an embodiment, the guiding surface continues uninterruptedly between the channel ends. The absence of any interruptions between the two channel ends reduces the risk that a strap gets jammed while being guided through the channel.

According to a further aspect of the invention, and in accordance with the effects and advantages as described above, there is provided a binding apparatus with a binding head for use in the assembly or for use in combination with the strap guiding device. The binding apparatus typically comprises a strap accumulator preloaded with strap material, a transport motor for retrieving strap material from the strap accumulator and guiding the strap material through the channel to form a loop, tensioning means for placing the strap material under tension and pulling it backward into the strap accumulator to reduce the size of the loop, and clamping means for connecting the strap ends after having tightened the loop around the bulky item.

In an embodiment, the binding head comprises a first channel guide portion connected to a front side of the binding head and/or a second channel guide portion connected to a receiving side of the binding head.

According to a further aspect of the invention, and in accordance with the effects and advantages as described above, there is provided a method for providing a bulky item with a strap, the method comprising: arranging a bulky item on a support within a strap guiding device; providing a binding apparatus with a binding head; controlling the binding apparatus to move the binding head near the opening in the channel of the strap guiding device and arrange the binding head to at least partially enter through the opening in the channel guide; spanning the opening in the channel to provide an uninterrupted channel; guiding a strap through the circumferentially extending channel using the binding apparatus; receiving a strap end of the strap in the binding head; and fastening the strap using the binding head. Advantageous is that the binding head can afterwards be moved out of the opening.

In an embodiment, the method further comprises moving the binding head of the binding apparatus to a position outside of the binding zone.

In an embodiment, the step of spanning the opening in the channel comprises controlling the binding apparatus to hold a channel guide segment in the opening.

In an embodiment, the step of fastening the strap comprises engaging an outer surface of the bulky item with the binding head; tightening the strap around the bulky item using the binding head; and connecting the strap end to a second strap end connected to the strap supply. Here the term "connecting" includes any conventional method of joining two strap ends together, for example using welding, gluing or by providing a seal around the strap ends.

In an embodiment, the method further comprises rotating the channel to a position wherein the opening in the channel is facing the binding apparatus; and/or rotating the channel to a position wherein the bulky item can be placed within the strap guiding device.

BRIEF DESCRIPTION OF DRAWINGS

Embodiments will now be described, by way of example only, with reference to the accompanying schematic drawings in which corresponding reference symbols indicate corresponding parts. In the drawings, like numerals designate like elements. Multiple instances of an element may each include separate letters appended to the reference number. For example, two instances of a particular element "20" may be labeled as "20*a*" and "20*b*". The reference number may be used without an appended letter (e.g. "20") to generally refer to an unspecified instance or to all instances of that element, while the reference number will include an appended letter (e.g. "20*a*") to refer to a specific instance of the element.

The figures are meant for illustrative purposes only, and do not serve as restriction of the scope or the protection as laid down by the claims.

DESCRIPTION OF EMBODIMENTS

The following is a description of certain embodiments of the invention, given by way of example only and with reference to the figures.

Figure 1A:
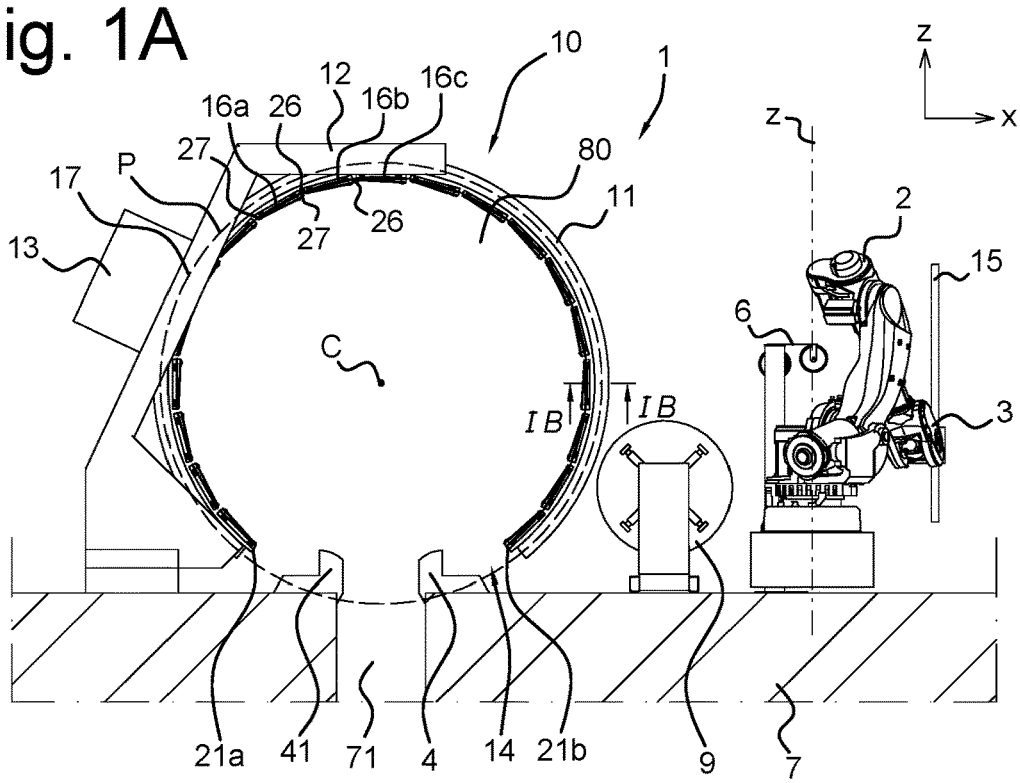
FIG. 1A schematically shows an assembly for providing a bulky item with a strap according to a first embodiment of the invention.

FIG. 1A schematically shows an axial view of a first embodiment of an assembly 1 for providing a bulky item with a strap around its outer circumferential surface. The assembly 1 comprises a strap guiding device 10, a binding apparatus 2 with a binding head 3, channel guide segment 15 and strap accumulator 6, a support 4 for supporting a bulky item 5 (not shown), and a strap dispenser 9. The assembly 1 is arranged on a floor 7 with a pit 71 at the position of the support 4.

The strap guiding device 10 is arranged on the floor 7 and has a channel support 11, a frame 12, a drive system 13 and a plurality of channel guide portions 16 defining a circumferentially extending channel 17. The channel support 11 carries the plurality of channel guide portions 16. Each channel guide portion 16 has a first portion end 26 and a second portion end 27. The plurality of channel guide portions 16 are arranged to form an arc shaped trajectory along a substantially circular path P, wherein the first portion end 26 of a first channel guide portion 16*a* is adjacent to the second portion end 27 of a second channel guide portion 16*b* to form the arc shaped trajectory. Each channel guide portion 16 is approximately 38 cm long as measured along the circular path P, yet it will be understood that not all channel guide portions 16 need to have the same length and that the channel guide portions 16 may be shorter or longer. The channel guide portions 16 are placed adjacent to each other, but do not abut. A space between 5 and 10 mm is left between each pair of adjacent channel guide portions 16.

The plurality of channel guide portions 16 define two exterior portion ends 21*a*, 21*b* that define an opening 14. The drive system 13 is configured to rotate the channel support 11 with the plurality of channel guide portions 16 around a center C to move the opening 14 along a substantially circular path P defined by the plurality of channel guide portions 16. The binding zone 80 is defined as the space circumferentially enclosed by the path P.

The support 4 is a saddle arranged to support a bulky item from below. The saddle 4 has four elevated surfaces 41 (only two are shown) that each can support part of the lower surface of the bulky item. The saddle 4 has an open structure, meaning that there is a passage provided between the four elevated surfaces 41. The passage provides access to the lower surface of a bulky item arranged on the support. The pit 71 in the floor 7 eases the arrangement of the bulky item on the support 4. The pit 71 may for example carry conveyance means that enable the positioning of a bulky item on the support 4. It will be understood that the support 4 may have a different shape or height dependent on the type of bulky item that is to be supported. The support 4 in the depicted embodiment is particularly suited for supporting a roll with metal wound sheets.

The plurality of channel guide portions 16 together form an arc shape with an arc angle of approximately 280 degrees and a diameter of 2.5 m. The opening 14 near the floor 7 and support 4 is dimensioned to fit around the support 4 and is approximately 1.5 m. It will be understood, however, that the strap guiding device 10 is easily scalable and can be adjusted based on the dimensions of the bulky item that is to be provided with a strap.

The channel guide segment 15 is also shaped as a circular arc (see FIG. 2A), having an arc angle of slightly less than 80 degrees. The channel guide segment 15 can thereby span the opening 14 in the plurality of channel guide portions 16, without entirely closing it. This enables the binding head 3 with the channel guide segment 15 attached thereto, to easily pass through the opening 14. The channel guide segment 15 is discussed in more detail with reference to FIG. 2A below.

Figure 1B:
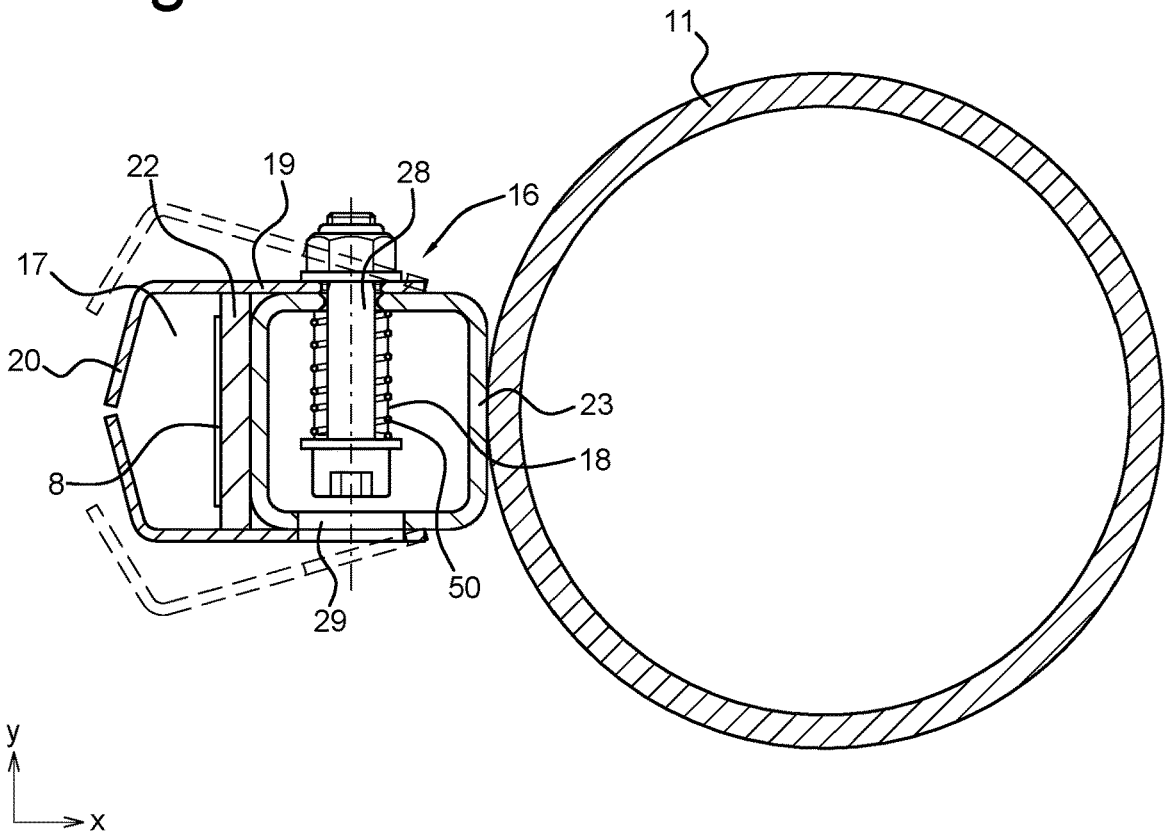
FIG. 1B shows a cross-sectional view of the channel support and the channel as indicated in FIG. 1A.

FIG. 1B illustrates a cross-sectional detail of the channel support 11 and one of the channel guide portions 16 as indicated in FIG. 1A. The channel guide portion 16 has a base 23, a guiding surface 22, and a retention system 50 comprising a retention element 19 with two sides 20 and spring elements 18 to bias the sides 20. Each side 20 of the retention elements is connected to the base 23 using a pair of bolts 28. Here only one bolt 28 is shown. The other side 20 comprises an opening 29 opposite to the bolt 28 to easy assembly.

The channel support 11 is formed by a circular tube (only partially shown) with a diameter of approximately 100 mm. The tube has been bent to form the arc shape as depicted in FIG. 1A. The base 23 is attached to an outer circumferential surface of the channel support 11. In the depicted embodiment, the base 23 is welded to the channel support 11, yet it will be understood that also mechanical fasteners such as bolts may be used.

The base 23 is shaped as a tube with an approximately square cross section. The base 23 provides a mounting structure for the guiding surface 22, which is provided at a side of the base 23. Along the guiding surface 22, the channel 17 is defined that can house the strap 8. The guiding surface 22 is smooth and provides little resistance when the binding strap 8 slides along the guiding surface 22. The guiding surface 22 is made of steel and continuous uninterruptedly through the plurality of the channel guide portions 16 between the channel ends 21*a*, 21*b*. The base 23 may also continue uninterruptedly through several of the channel guide portions 16, yet may alternatively also be provided as a separate straight profile for each of the channel guide portions 16.

The retention element 19 has two sides 20 that prevent a strap 8 that is arranged within the channel 17 to unintentionally escape from the channel 17. Each side 20 is approximately 38 cm long and connected to the base 23 using bolts near the portion ends 26, 27, of the respective channel guide portions 16. The spring element 18 enables the sides 20 of the retention element to hinge.

Each channel guide portion 16 has a similar retention element 19 that is biased by one or more spring elements 18. When a loop of strap material is tightened, the strap 8 may be pulled towards the sides 20 of the retention element 19 and under sufficient force, the tension of the spring element 18 may be overcome to widen the opening between the sides 20 and release the strap 8 from the channel 17. An open position for the retention element 19 is schematically indicated in FIG. 1B using dashed lines.

The binding apparatus 2 is a robot with a binding head 3 having six degrees of freedom. The first three degrees of freedom allow the binding head 3 to make translation movements in three-dimensional space. A fourth degree of freedom is used to tilt the binding head 3 in the correct position to interact with the strap guiding device 10. A fifth degree of freedom is used to turn the binding apparatus 2 around its own central axis Z and away from the strap guiding device 10 and bulky item 5. This enables the binding head 3 to be provided to an engineer at a position where it is safe to carry out maintenance on the binding head 3, or to carry out repairs in case of a failure of the binding head 3. The sixth degree of freedom is not required to perform the binding action. However, the sixth degree of freedom provides flexibility and can compensate for unprecise alignment of the binding apparatus 2 and the strap guiding device 10. Moreover, this additional degree of freedom is advantageous when carrying out maintenance as it enables positioning the binding head 3 in the best accessible position for an operator or engineer. The binding apparatus 2 further comprises the strap accumulator 6.

Figure 2A:
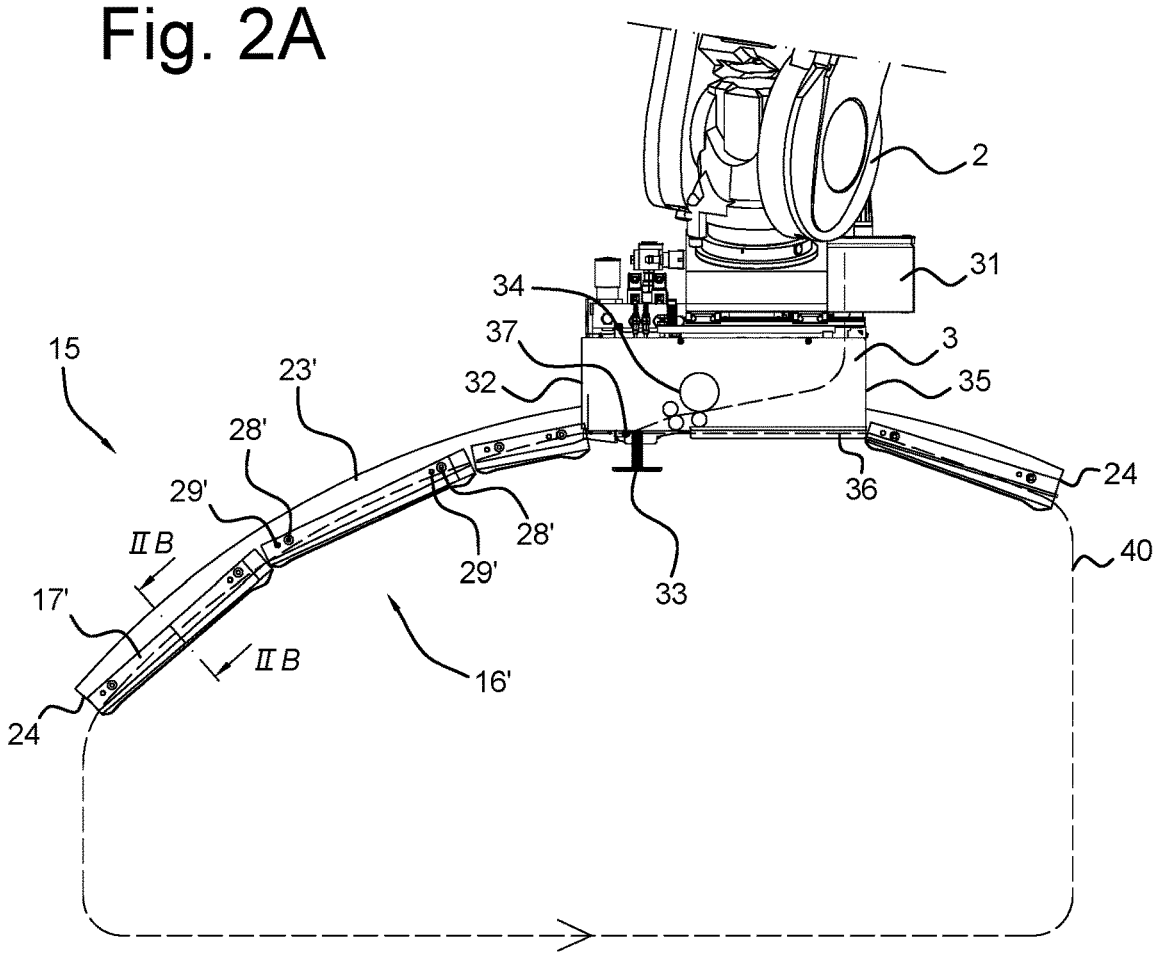
FIG. 2A shows a detail of the binding head on the binding apparatus in the assembly of FIG. 1A.

FIG. 2A shows the binding head 3 of the binding apparatus 2. The binding head 3 is provided with a strap intake unit 31, a front side 32, an alignment element 33, a plurality of transport rollers 34, a receiving side 35, a receiving channel 36 and a clamp unit 37. The channel guide segment 15 is defined between the two segment ends 24 and comprises a plurality of channel guide portions 16 extending from both sides 32, 36 of the binding head 3.

At the strap intake unit 31, strap material is provided from the strap accumulator 6 of the binding apparatus 2. The rollers 34, driven by a transport motor (not shown) lead the strap material 8 (indicated schematically) through the binding head 3 and towards the front side 32 where the strap material can enter the channel 17' that extends through the plurality of channel guide portions 16 in the channel guide segment 15 and in the strap guiding device 10. The strap material is guided around the bulky item to form a loop 40 (schematically indicated) and a strap end is received in the receiving channel 36 of the binding head 3 and clamped by the clamp unit 37. The clamp unit 37 can hold the strap end while the loop 40 is tightened. The excess of strap material can be pulled back into the strap accumulator 6 using the transport motor or a separate tensioning motor. Once the loop 40 is sufficiently tight, the clamp unit 37 can connect the ends of the strap material together and cut the loop 40 loose from the supply of strap material to form a closed loop.

The channel guide segment 15 comprises a plurality of channel guide portions 16 and the receiving channel 36 of the binding head 3. More specifically, three channel guide portions 16 are extending from the front side 32 of the binding head 3 and one channel guide portion 16 is extending from the receiving side 35. It will be understood that in embodiments, the number of channel guide portions 16 may be different. For example, the channel guide segment 15 may also be fully integrated with the binding head 3 and the channel guide segment may therefore in embodiments only comprise a receiving channel and/or an integrally formed channel portion extending from the front side of the channel guide.

Figure 2B:
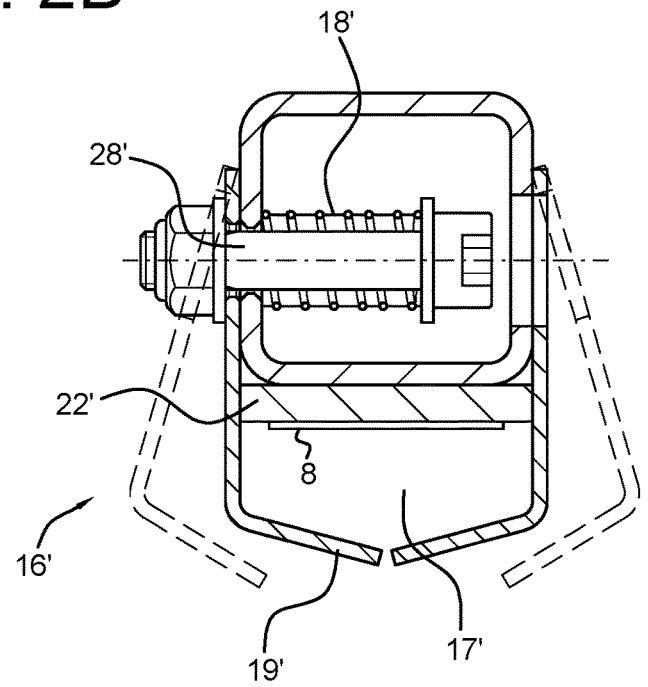
FIG. 2B shows a cross-sectional view of the channel guide segment as indicated in FIG. 2A.

FIG. 2B illustrates a cross-sectional detail of one of the channel guide portions 16'. The channel guide portion 16' is formed very similar to the plurality of channel guide portions 16, but due to its shorter length, a channel support 11 is not needed. The channel guide portions 16' are directly connected to a base 23' that extend along the length of three retention elements 19'. The channel 17 that extends through the channel guide portions 16 of the strap guiding device 10 can uninterruptedly continue into the channel 17' that extends through the channel guide portions 16' of the channel guide segment 15.

FIGS. 3A-3G show a method for providing a bulky item 5 with a strap using the assembly 1 in FIG. 1. FIG. 2A illustrates the assembly 1 after a bulky item 5 has been arranged on the support 4. The bulky item 5 is a roll with a metal wound sheet. The roll has a lower surface 51 and an eye 52.

Figure 3A:
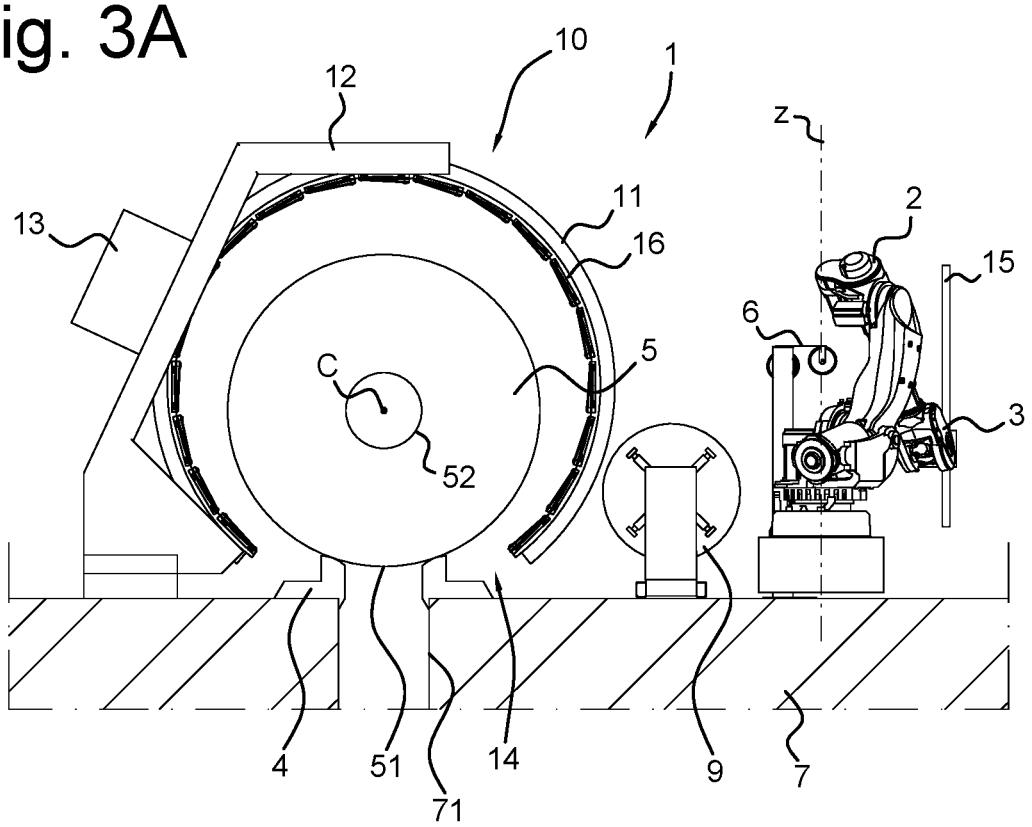
FIG. 3A-3G schematically illustrate stages of a method for providing a bulky item with a strap using the assembly in FIG. 1.
Figure 3B:
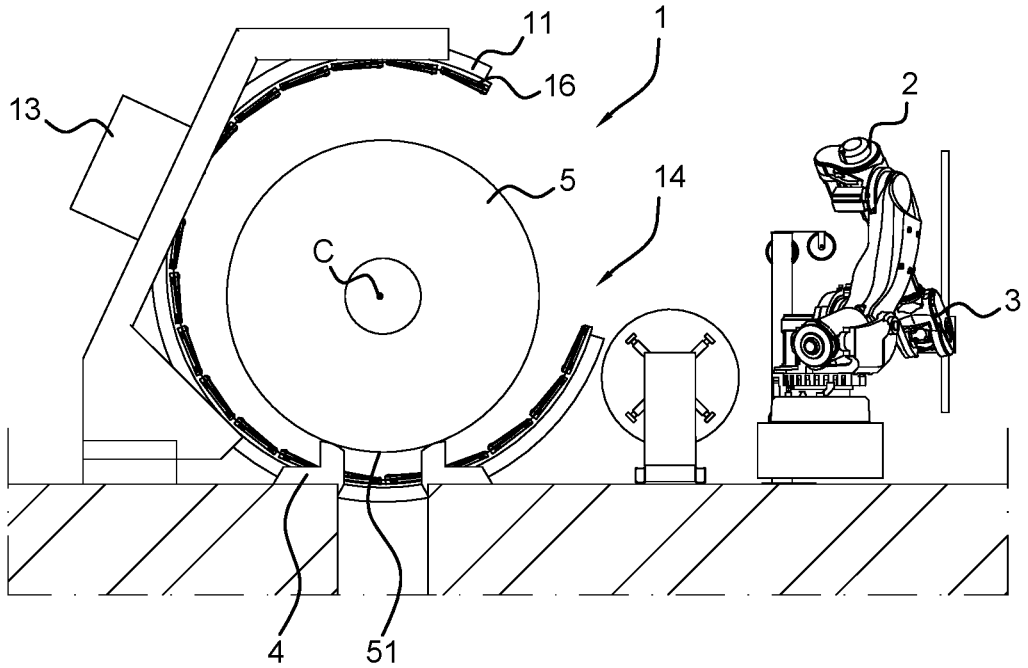

FIG. 3B illustrates the assembly 1, wherein the drive system 13 of the strap guiding device 10 has been controlled to rotate the channel support 11 with the plurality of channel guide portions 16 around the center C. In this position it is typically not easily possible to remove the bulky item 5 from the support 4 since the floor pit 71 is closed by the strap guiding device 10. The opening 14 has been moved from a first position wherein the bulky item 5 could be easily arranged on the support 4, to a second position wherein the opening 14 faces the binding apparatus 2. In the first position, the opening 14 was provided below the lower surface 51 of the bulky item 5, and in the second position the plurality of channel guide portions 16 are arranged to surround the lower surface of the bulky item 5.

Figure 3C:
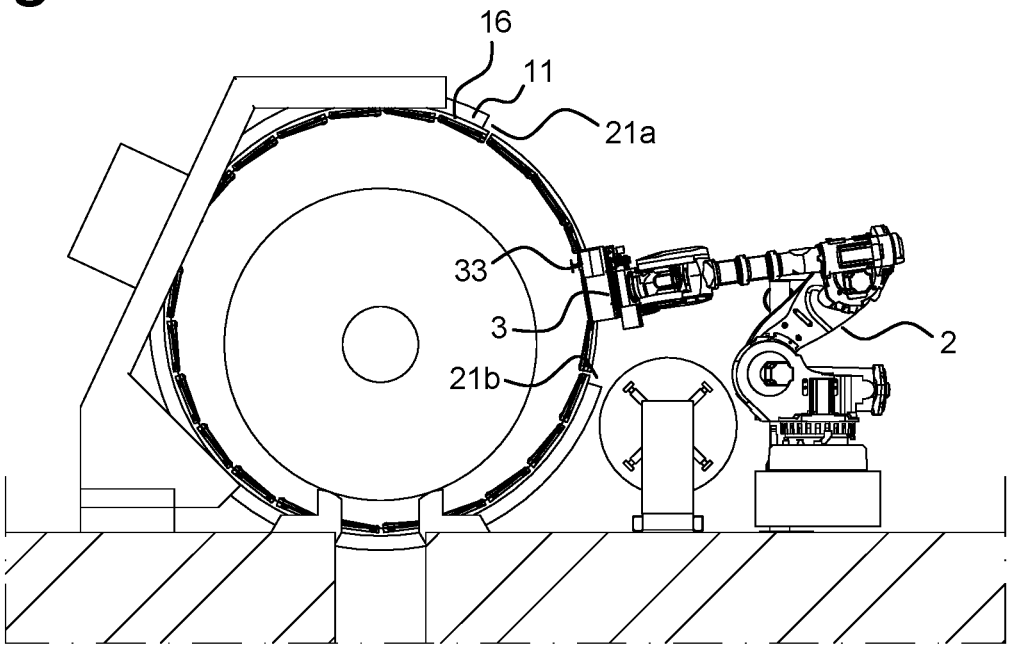

FIG. 3C illustrates the assembly 1 after the binding apparatus 2 has arranged the channel guide segment 15 between the channel ends 21. The channel guide segment 15 spans the opening 14 and the alignment element 33 of the binding head 3 has entered through the opening 14 into the binding zone. The plurality of channel guide portions 16 and guide segment 15 are arranged to form the uninterrupted channel 17 that extends circumferentially around the bulky item 5.

Figure 3D:
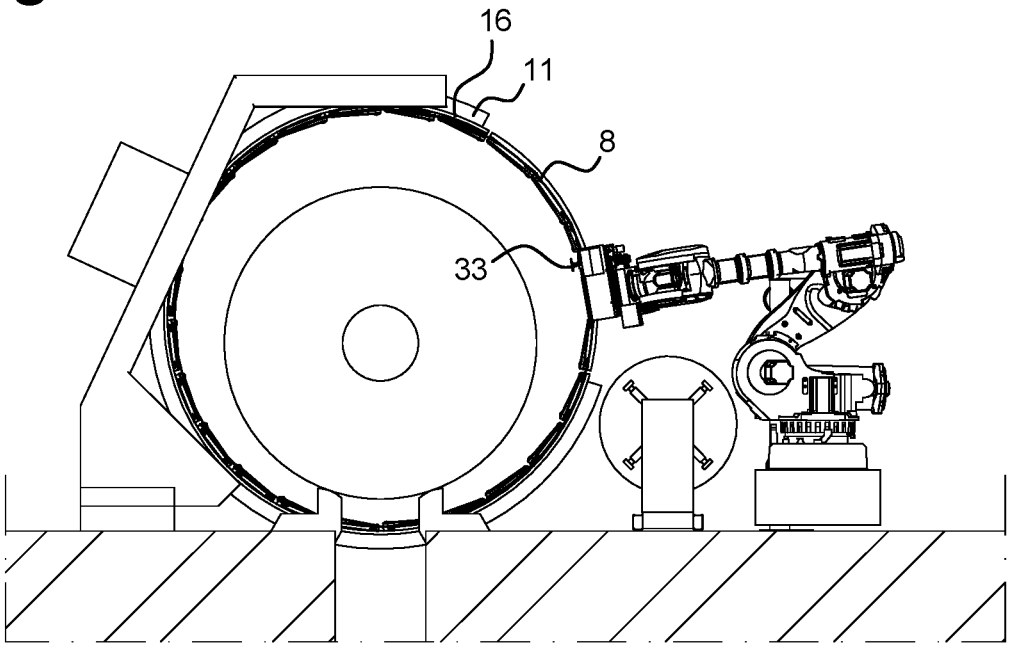

FIG. 3D illustrates the assembly after a strap 8 has been guided through the circumferentially extending plurality of channel guide portions 16 to surround the bulky item 5. The strap 8 is made of steel, but it will be understood that other types of strap may also be provided using the assembly. The binding head 3 of the apparatus 2 can easily be replaced to also hold other materials and allow for other methods of connecting. The strap 8 has been guided through the channels 17, 17' in the strap guiding device 10 and channel guide segment 15 and received in the receiving channel 36 of the binding head 3 as described in relation to FIG. 2A above.

Figure 3E:
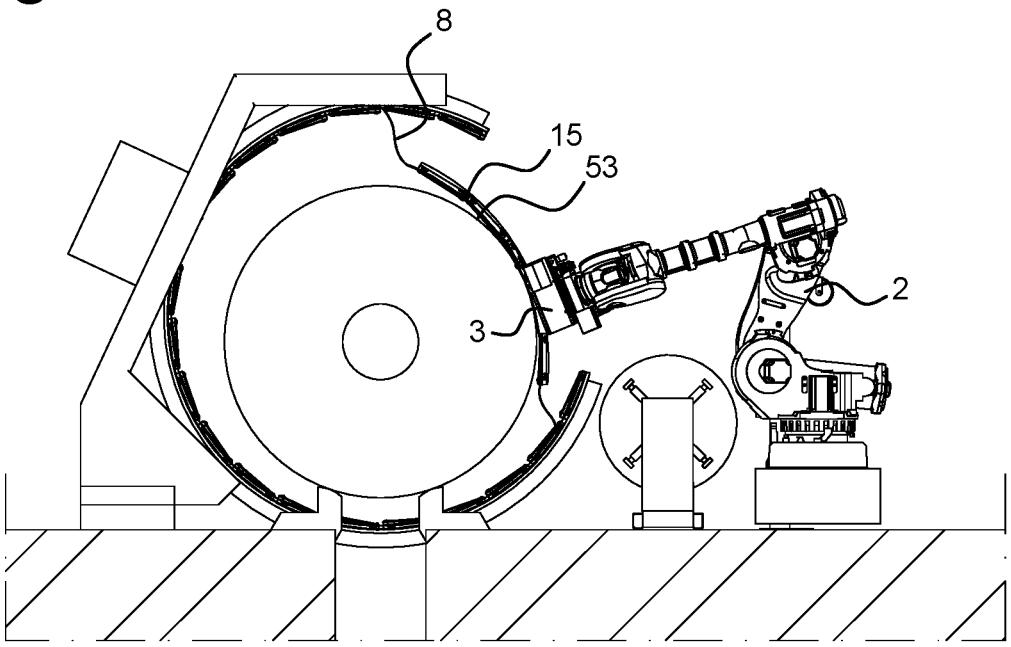

FIG. 3E illustrates how the binding head 3 engages the circumferential surface 53 of the bulky item 5. While the binding head 3 is moved towards the surface 53, the tensioning motor pulls back part of the strap material into the accumulator 6. The combination of moving the binding head 3 and tensioning the strap leads to the release of the strap material from the channel 17. The strap material is pulled onto the sides 20 of the retention elements, which open once the tension of the spring elements 18 has been overcome.

Figure 3F:
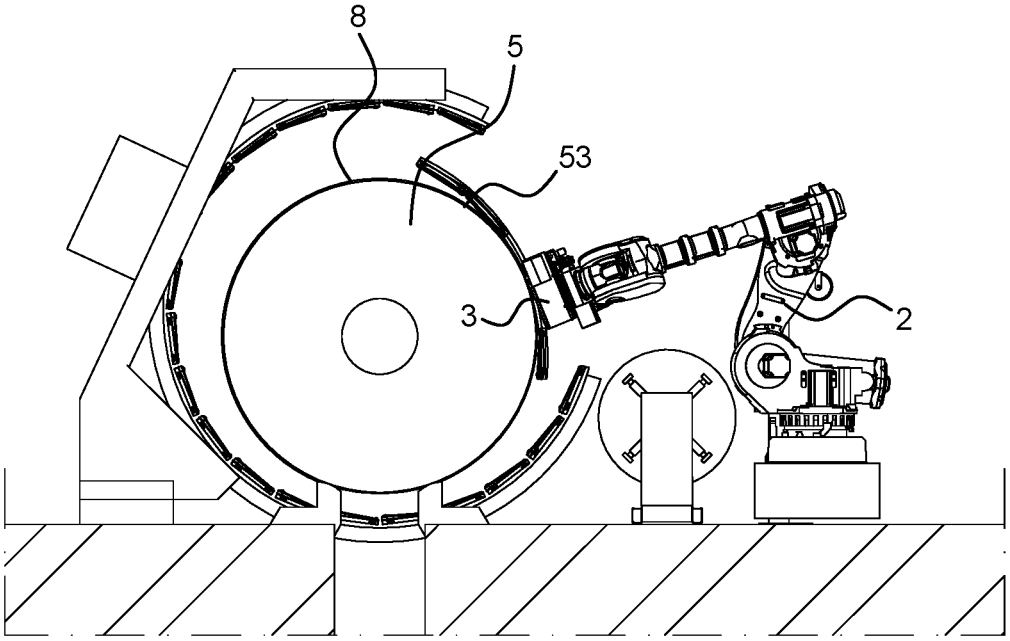

FIG. 3F illustrates how the binding head tightens the strap 8 around the bulky item 5. The accumulator 6 retrieves the excess strap material and the clamp unit 37 of the binding head 3 fastens the strap 8 around the bulky item 5 by joining the strap end to another part of the strap 8.

Figure 3G:
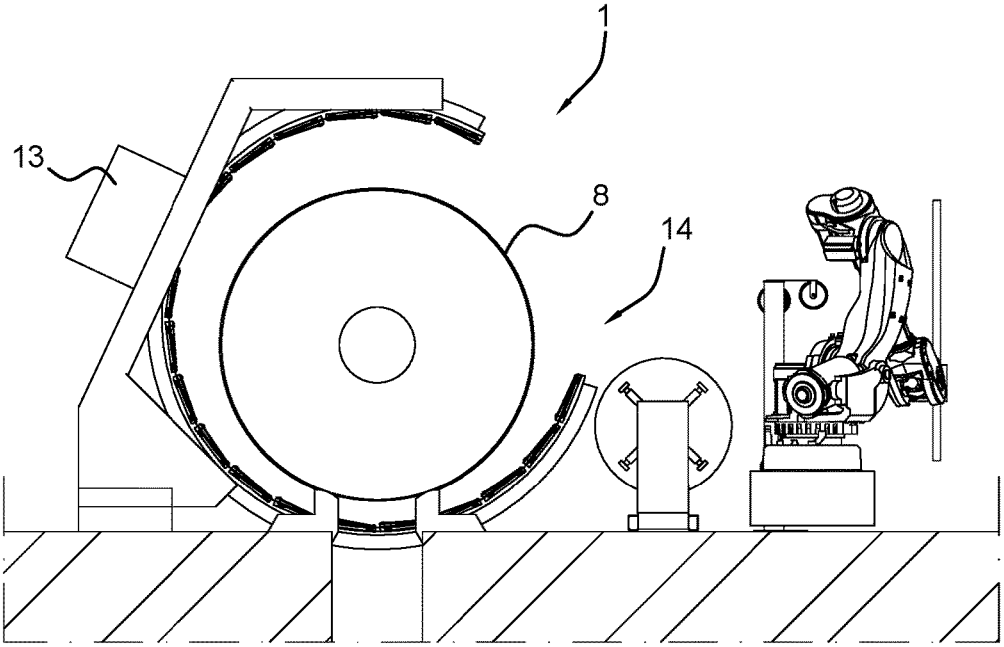

FIG. 3G illustrates the assembly 1 after the strap 8 has been provided and the apparatus 2 with binding head 3 has disengaged the bulky item 5. The drive system 13 may now rotate the plurality of channel guide portions 16 back to the first position as depicted in FIG. 2A to enable removal of the bulky item 5 from the support 4.

In the described embodiment, the guiding surface 22 is smooth and uninterrupted between the channel ends 22. Along the path of the strap, the strap encounters only two transitions in the guiding surface 22, where the first and last channel guide portions 16 connect to the channel guide segment 15. These transitions could cause a malfunctioning when the strap 8 is guided through the channel 17 and by limiting the number of transitions, the likelihood of errors is small.

In contrast, a bayonet solution as known from the prior art has not only two transitions near the binding head, yet in addition a strap guiding device with a bayonet solution would have two or three transitions at the position where the bayonet is arranged. Consequently, a solution with a bayonet is much more prone to failure than a solution with a rotating plurality of channel guide portions 16, because the strap material is more likely to get blocked at a transition. The strap guiding device 10 with a rotatable channel guide minimizes the number of transitions along the guiding surface 22 and thereby improves the reliability of the strapping process.

Figure 4:
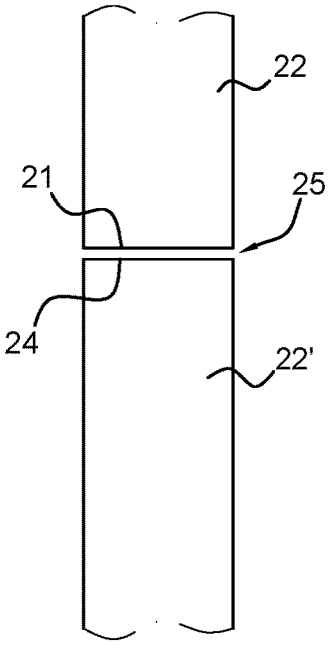
FIG. 4 shows a detail of the transition between the guiding surface of the strap guiding device and the guiding surface of the channel guide segment according to a first embodiment.

FIG. 4 shows a simplified view of a detail of the transition between the guiding surface 22 of the plurality of channel guide portions 16 and the segment guiding surface 22' of the plurality of channel guide portions 16' of the channel guide segment 15. To avoid or reduce problems in the transition between the two, it is important that the guiding surfaces 22, 22' are sufficiently smooth and have as few interruptions along the surface as possible. In this first embodiment both the channel end 21 and a segment end 24 of the channel guide segment 15 are planar. When the opening 14 between the channel ends 21 is spanned by the channel guide segment 15, a gap 25 of approximately 5 mm remains between the ends 21, 24. This small gap 25 is sufficiently large to enable a smooth passage of the binding head 3 with the channel guide segment 15 through the opening 14 between the channel ends 21. However, the gap 25 is also sufficiently small to not cause problems when passing the strap 8 through the channel 17.

Figure 5:
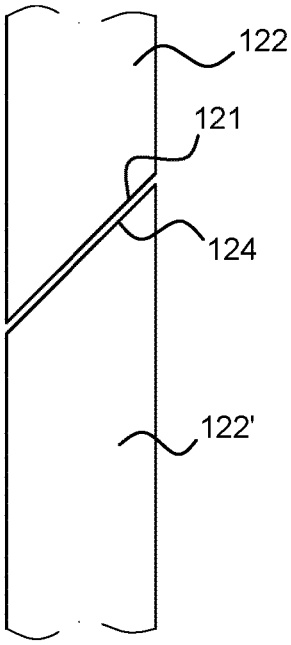
FIG. 5 shows a detail of the transition between the guiding surface of the strap guiding device and the guiding surface of the channel guide segment according to another embodiment.
Figure 6:
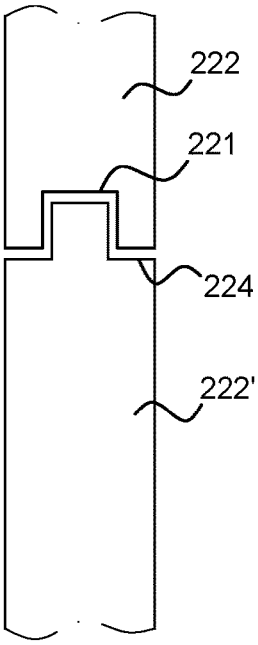
FIG. 6 shows a detail of the transition between the guiding surface of the strap guiding device and the guiding surface of the channel guide segment according to yet another embodiment.

FIGS. 5 and 6 show a detail of an alternative embodiment of a transition between guiding surfaces 122, 122' and a transition between guide surfaces 222, 222'. In FIG. 5, the channel end 121 is provided with a transverse edge. segment end 124 is complementary in shape. In FIG. 6 the channel end 221 is provided with a female receiving portion. The segment end 224 is provided with a male portion and is complementary in shape. It can have advantages for the reliability of the strap 8 passing to provide a configuration wherein the ends 121, 124 of the channel guide and channel guide segment partially overlap. Since the strap 8 typically is provided with a straight end, this the likelihood that a strap 8 gets blocked at a transition from the channel guide 16 to channel guide segment 15 or vice versa. In FIGS. 3 to 5, the strap material is passed the segment guiding surface 22' of the channel guide segment 15 to the guiding surface 22 of plurality of channel guide portions 16.

Figure 7:
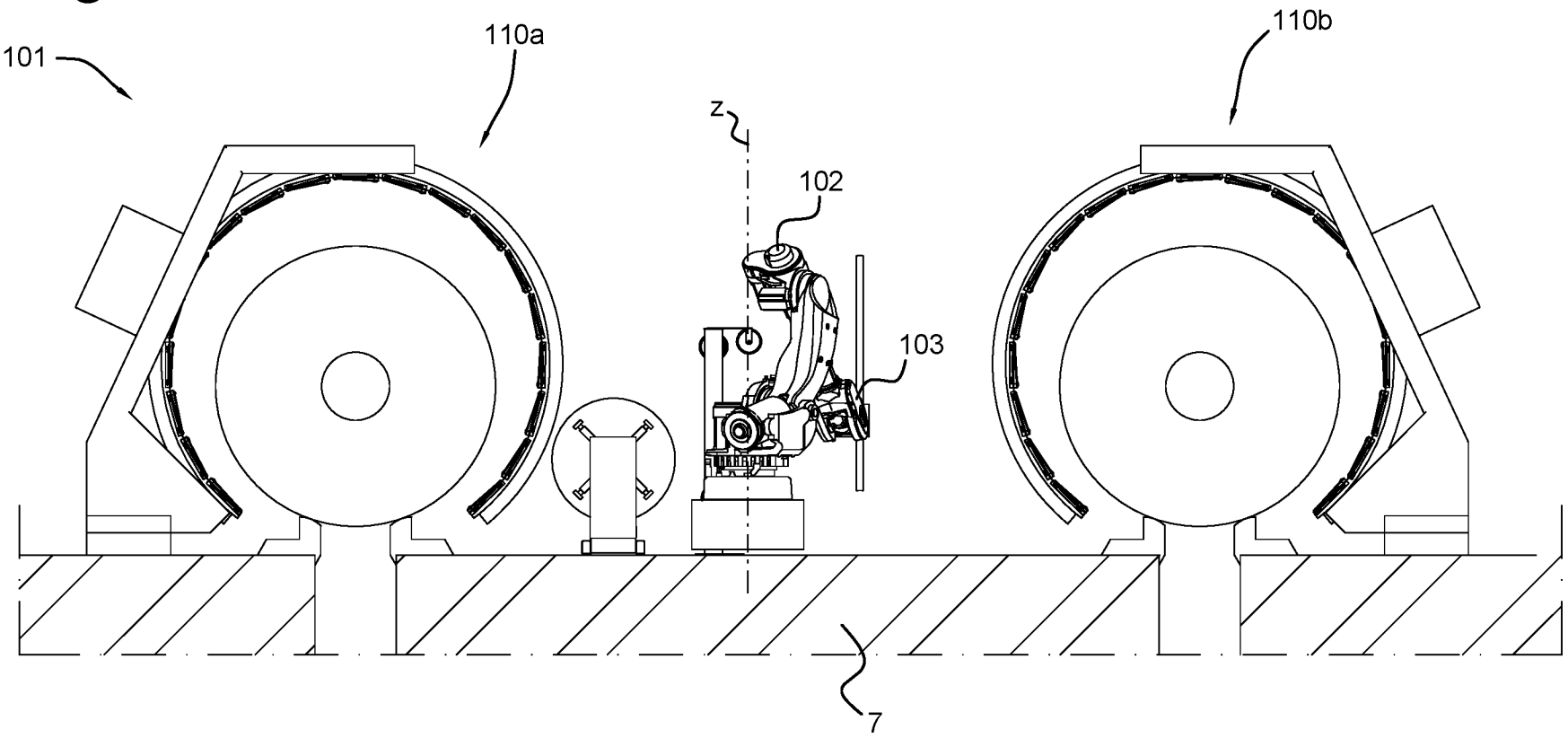
FIG. 7 shows an assembly for providing a plurality of bulky items with a strap according to a further embodiment of the invention.

FIG. 7 shows a further embodiment of an assembly 101 according to the invention. The assembly comprises two supports 4*a*, 4*b* and two strap guiding devices 110*a*, 110*b*, but only one apparatus 102 with a binding head 103. The apparatus 102 is arranged at a position between the two strap guiding devices 110. The apparatus 102 is a robot with six degrees of freedom. Rotation around the robot's own central axis z enables the robot 2 to operate both strap guiding devices 110*a*, 110*b* alternately. While a first bulky item 5 is removed and replaced in the first strap guiding device 110*a*, a second bulky item 5 in the strap guiding device 110*b* can be strapped by the apparatus 2 and vice versa. Consequently, only one binding apparatus 2 is required instead of two, which can significantly reduce the costs of the strapping process.

In the foregoing description of the figures, the invention has been described with reference to specific embodiments thereof. It will, however, be evident that various modifications and changes may be made thereto without departing from the scope of the invention as summarized in the attached claims. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. In particular, combinations of specific features of various aspects of the invention may be made. An aspect of the invention may be further advantageously enhanced by adding a feature that was described in relation to another aspect of the invention.

The invention claimed is:

1. An assembly for applying a strap around an outer circumferential surface of a bulky item, the assembly comprising:

a binding zone configured to receive the bulky item;

a strap guiding device with a rotatable channel support supporting a guiding surface, wherein a channel is defined along the guiding surface, the channel surrounding the binding zone and configured to guide a strap material around the bulky item; and a binding apparatus with a binding head for delivering the strap material to the channel and for fastening a first end of the strap material to a second end of the strap material to form the strap;

wherein the channel has two channel ends that define an opening formed between the channel ends and the binding head can pass through the opening, wherein the binding apparatus is configured to move the binding head to a first position in alignment with the channel from which the binding head can shoot the strap material into the channel, a second position inside the binding zone to engage the outer circumferential surface of the bulky item where the binding head can fasten the strap, and a third position outside of the binding zone and the opening, and wherein the channel support and the channel rotate around the bulky item to move the opening around the bulky item to a plurality of positions to allow placement of the bulky item into the binding zone and placement of the binding head between the channel ends.

2. The assembly according to claim 1, wherein the strap guiding device further comprises:

a frame for rotatably supporting the channel support; and a drive system for rotating the channel support.

3. The assembly according to claim 1, wherein the channel support can be rotated can be rotated to move the opening between at least a first position wherein the bulky item can be placed within the strap guiding device and a second position wherein the opening in between the channel ends is facing the binding apparatus.

4. The assembly according to claim 1, wherein the binding head is configured to make a movement along a non-straight trajectory.

5. The assembly according to claim 1, wherein the assembly further comprises a second strap guiding device configured to be used alternatingly in combination the binding head of the binding apparatus.

6. The assembly according to claim 1, wherein the binding apparatus comprises a channel guide segment, configured to span or close the opening between the channel ends.

7. The assembly according to claim 6, wherein the channel guide segment has two segment ends and the channel guide segment is configured to provide for a gap between each of the channel ends and the segment ends when the channel guide segment spans the opening between the channel ends, wherein the gaps may have a size of maximum 15 mm.

8. The assembly according to claim 7, wherein the channel is defined along a guiding surface that continues uninterruptedly between the channel ends.

9. The assembly according to claim 8, wherein the channel guide segment has a guiding surface between the two segment ends, wherein the guiding surface at the channel ends is non-planar and wherein the segment guiding surface at the segment ends is complementary in shape to the guiding surface at the channel ends.

10. The assembly according to claim 6, wherein the channel guide segment is straight or arc shaped.

11. The assembly according to claim 6, wherein the binding head has two sides, each side facing one of the channel ends, and wherein the channel guide segment extends from one or both sides of the binding head.

12. A strap guiding device in combination with a binding apparatus for guiding a strap around an outer circumferential surface of a bulky item, the strap guiding device comprising:

a channel at least partially circumferentially extending around a binding zone for the bulky item, the channel having two channel ends that define an opening through which a binding head of the binding apparatus can pass, wherein the channel ends provide access for the binding apparatus for guiding a strap through the channel;

a rotatable channel support supporting a guiding surface, wherein the channel is defined along the guiding surface;

a frame for rotatably supporting the channel support; and a drive system for rotating the guiding surface and the channel around a center of a circular path, wherein the channel support and the channel rotate around the bulky item to move the opening around the bulky item from a first position where the bulky item can be placed in the binding zone to a second position where the opening between the channel ends is facing the binding apparatus and allowing the binding head to move through the opening to engage the outer circumferential surface of the bulky item to fasten the strap.

13. The strap guiding device according to claim 12, further comprising a plurality of channel guide portions, wherein the plurality of channel guide portions are supported by the channel support and wherein the plurality of channel guide portions together with the guiding surface define the circumferentially extending channel, wherein the channel guide portions at least partially enclose the channel.

14. The strap guiding device according to claim 13, wherein each channel guide portion is provided with a retention system for selectively retaining the strap within the channel guide portion.

15. The strap guiding device according to any of claim 12, wherein the guiding surface continues uninterruptedly between the channel ends.

16. A method for providing a bulky item with a strap, the method comprising:

arranging a bulky item on a support within a strap guiding device, wherein the strap guiding device comprises:

a channel at least partially circumferentially extending around a binding zone for the bulky item, the channel having two channel ends that define an opening through which a binding head of a binding apparatus can pass, wherein the channel ends provide access for the binding apparatus for guiding a strap through the channel;

a rotatable channel support supporting a guiding surface, wherein the channel is defined along the guiding surface;

a frame for rotatably supporting the channel support; and a drive system for rotating the guiding surface and the channel around a center of a circular path, wherein the channel support and the channel rotate around the bulky item to move the opening around the bulky item from a first position where the bulky item can be placed in the binding zone to a second position where the opening between the channel ends is facing the binding apparatus;

controlling the binding apparatus to move the binding head near the opening and arrange the binding head to at least partially enter through the opening between the channel ends;

spanning the opening with a channel guide segment of the binding apparatus to provide a circumferentially extending channel;

guiding a strap through the circumferentially extending channel using the binding apparatus;

receiving a strap end of the strap in the binding head; and engaging an outer circumferential surface of the bulky item with the binding head and fastening the strap using the binding head.

17. The method according to claim 16, further comprising moving the binding head of the binding apparatus to a position outside of the binding zone.

18. The method according to claim 16, wherein spanning the opening in the channel comprises controlling the binding apparatus to hold the channel guide segment in the opening.

19. The method according to claim 16, wherein fastening the strap comprises engaging an outer surface of the bulky item with the binding head;

tightening the strap around the bulky item using the binding head; and connecting the strap end to a second strap end.

20. The method according to claim 16, wherein the method further comprises rotating the channel to a position wherein the opening in the channel is facing the binding apparatus; and/or rotating the channel to a position wherein the bulky item can be placed within the strap guiding device.

* * * * *